US011452393B2

(12) United States Patent
Wilson

(10) Patent No.: US 11,452,393 B2
(45) Date of Patent: Sep. 27, 2022

(54) BOTTLE CONVERTIBLE TO A GLASS

(71) Applicant: Danny Wilson, Kenthurst (AU)

(72) Inventor: Danny Wilson, Kenthurst (AU)

( * ) Notice: Subject to any disclaimer, the term of this patent is extended or adjusted under 35 U.S.C. 154(b) by 0 days.

(21) Appl. No.: 16/963,835

(22) PCT Filed: Jan. 22, 2019

(86) PCT No.: PCT/AU2019/000009
§ 371 (c)(1),
(2) Date: Jul. 22, 2020

(87) PCT Pub. No.: WO2019/144178
PCT Pub. Date: Aug. 1, 2019

(65) Prior Publication Data

US 2021/0052092 A1 Feb. 25, 2021

(30) Foreign Application Priority Data

Jan. 23, 2018 (AU) ..... 2018900213

(51) Int. Cl.

| | |
|---|---|
| ***A47G 19/22*** | (2006.01) |
| ***B65D 1/02*** | (2006.01) |
| ***B65D 1/06*** | (2006.01) |
| ***B65D 21/02*** | (2006.01) |
| ***B65D 51/24*** | (2006.01) |

(52) U.S. Cl.
CPC ..... *A47G 19/2255* (2013.01); *B65D 1/0207* (2013.01); *B65D 1/06* (2013.01); *B65D 21/0228* (2013.01); *B65D 51/249* (2013.01); *A47G 2019/2277* (2013.01)

(58) Field of Classification Search
CPC ..... A47G 19/2255; A47G 19/2205; B65D 1/0207; B65D 1/06; B65D 51/0228; B65D 51/249; B65D 51/24; A45F 3/16
USPC .... 220/703, 630, 628, 23.86, 23.83; 215/44, 215/43, 376, 377, 6, 45; 206/218, 217, 206/216, 547, 541, 223
See application file for complete search history.

(56) References Cited

U.S. PATENT DOCUMENTS

| | | | | |
|---|---|---|---|---|
| 640,860 A * | 1/1900 | Baum, Jr. | ..... | A47G 19/2255 215/377 |
| 2,086,404 A * | 7/1937 | Daniels | ..... | B65D 51/249 215/377 |
| 6,216,897 B1 * | 4/2001 | Wagner | ..... | B65D 23/04 215/329 |
| 6,398,050 B1 * | 6/2002 | Allora | ..... | A47G 19/2255 215/228 |

(Continued)

*Primary Examiner* — Robert J Hicks

(57) ABSTRACT

The present invention is a bottle that can be transformed into a glass. The bottle includes a first portion for holding a first serve of a beverage, and a second portion adapted for holding a second serve of the beverage. The second portion and the first portion are configured to removably engage to each other using an engaging mechanism. The bottle further includes one or more closure members that removably engage to the second portion or are retained within a void region within the first portion. Further, when the bottle is in use, the closure member is removed and connected on top of the first portion to form the glass in order to consume the first serve of the beverage contained therein, and if needed, refill the glass with the second serve of the beverage contained in the second portion.

9 Claims, 11 Drawing Sheets

(56) References Cited

U.S. PATENT DOCUMENTS

| | | | | |
|---|---|---|---|---|
| 6,662,959 | B1 * | 12/2003 | Westerhold | A47G 19/2255<br>215/377 |
| 7,997,434 | B2 * | 8/2011 | Benetti | B65D 51/249<br>215/376 |
| 2005/0092760 | A1 * | 5/2005 | Westerhold | A47G 19/2255<br>220/703 |
| 2005/0098526 | A1 * | 5/2005 | Catalin | B65D 21/0231<br>215/6 |
| 2008/0011748 | A1 * | 1/2008 | Meyer | B65D 51/249<br>220/23.83 |

* cited by examiner

BOTTLE CONVERTIBLE TO A GLASS

CROSS-REFERENCE TO RELATED PATENT DOCUMENTS

This application is a national phase application of PCT/AU2019/000009, filed Jan. 22, 2019, which claims priority to Australian Provisional Application No. 2018900213, filed on Jan. 23, 2018, which are hereby incorporated by reference in its entirety

FIELD OF INVENTION

The present disclosure generally relates to a combination of bottle and glass. More specifically, the present disclosure relates to a bottle that can be converted into a glass or a wine glass that can hold one serve of a beverage and a reserve cup or container that can hold another serve of the beverage.

BACKGROUND

Generally, people purchase beverages such as water, wine, juice and so on in a bottle. After purchasing the bottle, people use a glass separately in order to pour the beverage into the glass to consume the beverage. Usually, the bottle packaging is designed based on the type of beverage.

With advent in technology and modern equipment, convenient packaging for beverages has become an important marketing consideration for consumers. For certain beverages such as wine, it is widely seen that manufacturers provide a single serve bottle. The single serve bottle, however, is not as desirable for enjoying beverages especially beverages like wine as the wine may lose its freshness if the bottle is kept open for long time. Again, when people carry such single serve bottles with them for various events and for outings, they are required to separately carry a glass that complement to the type of beverage. Not only is this, for lot of people, single serve beverage not always enough.

Therefore, there is a need for a bottle that would overcome above mentioned challenges, and is efficient and economical to produce.

SUMMARY

The above-mentioned problems are addressed by providing a bottle for storing beverage (two serves of beverage) and where the bottle can be transformed into an aesthetically pleasing glass for consuming the beverage.

Another objective of the present invention is to provide a convertible bottle that can be produced economically in a reusable or in a disposable form using suitable materials.

According to the embodiments of the present invention, a bottle convertible to a glass is provided. The bottle includes a first portion adapted for holding a first serve of a beverage, the first portion comprising a bowl portion, and a neck portion, a second portion adapted for holding a second serve of the beverage, wherein the second portion, and the first portion are configured to removably engage to each other using an engaging mechanism, at least one first closure member that removably engages to a receiving end of the second portion, and wherein, the bottle when in use, the first closure member is removed and connected on top of the neck portion of the first portion to form the glass in order to consume the first serve of the beverage contained therein, and if needed refill the glass with the second serve of the beverage contained in the second portion. The second portion is preferably cylindrical.

According to the embodiments, the engaging mechanism comprises of: one or more grooves circumferentially present over inner wall of the bowl potion of the first portion, and one or more notches circumferentially present over outer surface of an engaging end of the second portion.

According to the embodiments, the bottle convertible to the glass further comprises at least one second closure member removably housed within a void region present in the first portion. Further, the bottle when in use, the second closure member can be removed and connected on top of the neck portion of the first portion to form the glass in order to consume the first serve of the beverage contained therein.

According to the embodiments, the first serve of the beverage and the second serve of the beverage are similar beverages or dissimilar beverages.

According to the embodiments, the first portion, the second portion, the at least one first closure member, the at least one second closure member are preferably made of but not limited to plastic material, ceramic material, stainless steel or other metallic material, bioresins, wooden material, and glass material.

According to the embodiments, the bottle convertible to the glass further comprises at least one drink seal for sealing the beverage contained within the first portion and die second portion to prevent spilling of the first serve and the second serve of the beverage when the first portion and the second portion of the bottle is disengaged to form the glass for consuming the first serve of the beverage, and the second serve of the beverage.

The features and advantages described in this summary and in the following detailed description are not all-inclusive, and particularly, many additional features and advantages will be apparent to one of ordinary skill in the relevant art, in view of the drawings, and specification thereof. Moreover, it should be noted that the language used in the specification has been principally selected for readability and instructional purposes, and may not have been selected to delineate or circumscribe the inventive subject matter.

BRIEF DESCRIPTION OF DRAWINGS

In the following drawings, like reference numbers are used to refer to like elements. Although the following figures depict various examples of the invention, the invention is not limited to the examples depicted in the figures.

DETAILED DESCRIPTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

Proposed invention discloses a bottle that can easily be converted into an aesthetically pleasing glass and can hold two serve of beverage. The embodiments of the present invention will now be described in detail with respect to the accompanying figures, namely FIGS. 1-17.

Figure 1:
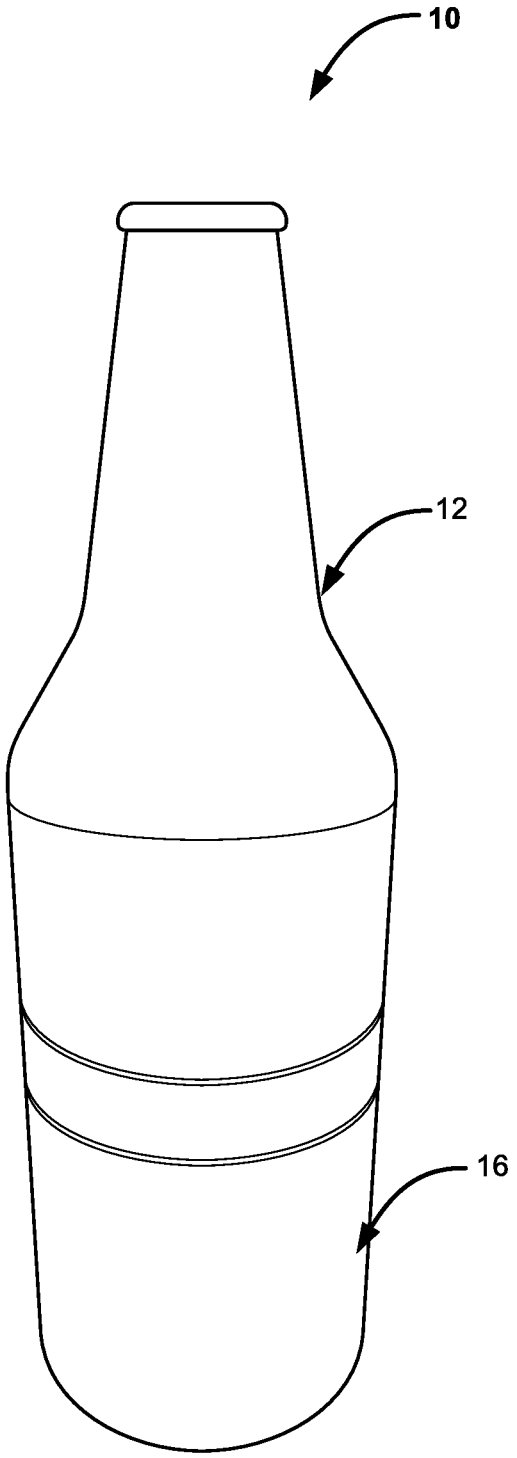
FIG. 1 illustrates a bottle that can be transformed into a glass, in accordance with one embodiment of the present disclosure.

Referring to FIG. 1, a bottle 10 that can be converted or transformed into a glass is disclosed. The bottle 10 comprises a first portion 12 and a second portion 16.

Figure 2:
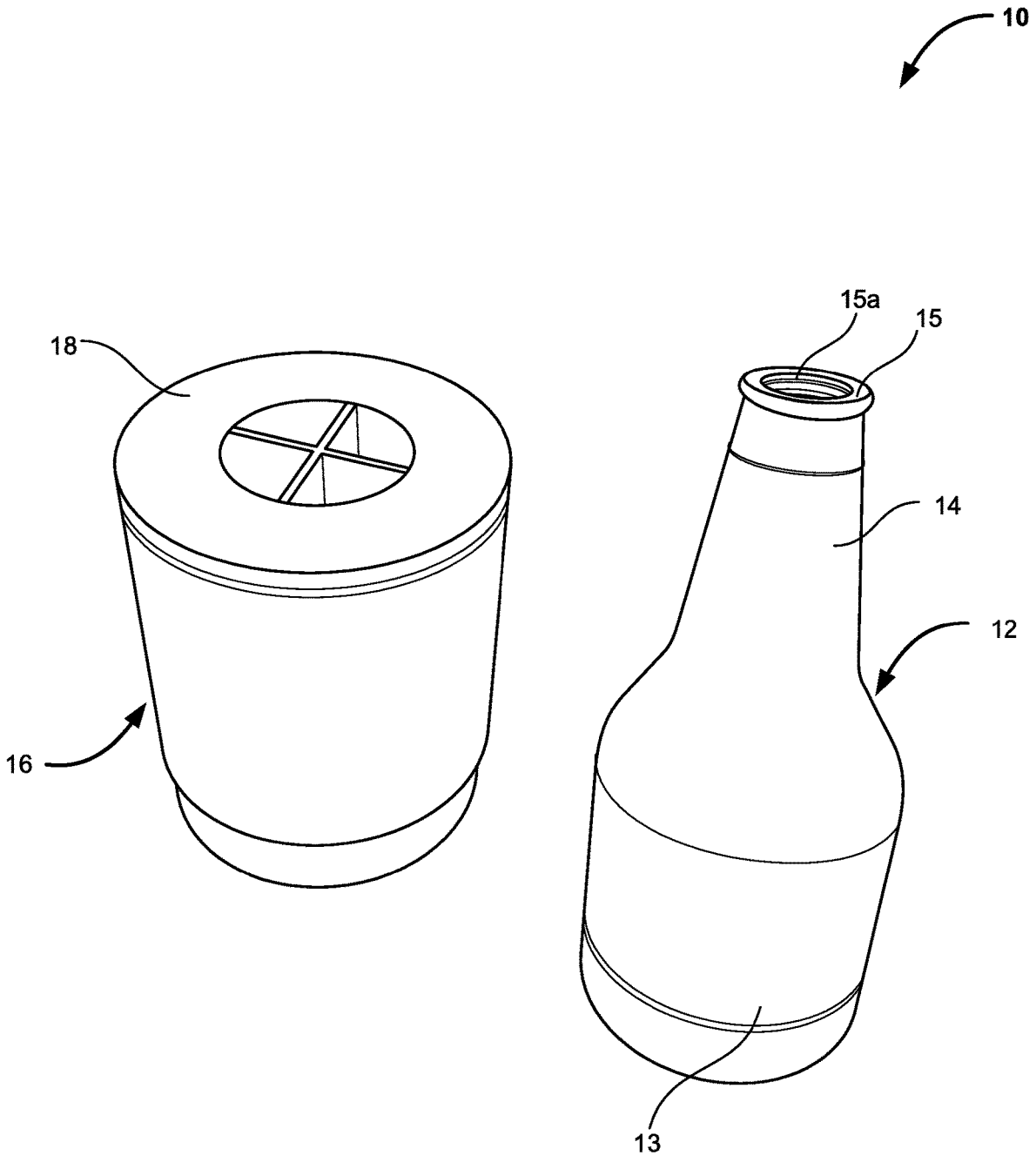
FIG. 2 illustrates a first portion and a second portion of the bottle in a disengaged form, in accordance with one embodiment of the present disclosure.

Referring to FIG. 2, the first portion 12 and the second portion 16 of the bottle in a disengaged form is shown.

Figure 3:
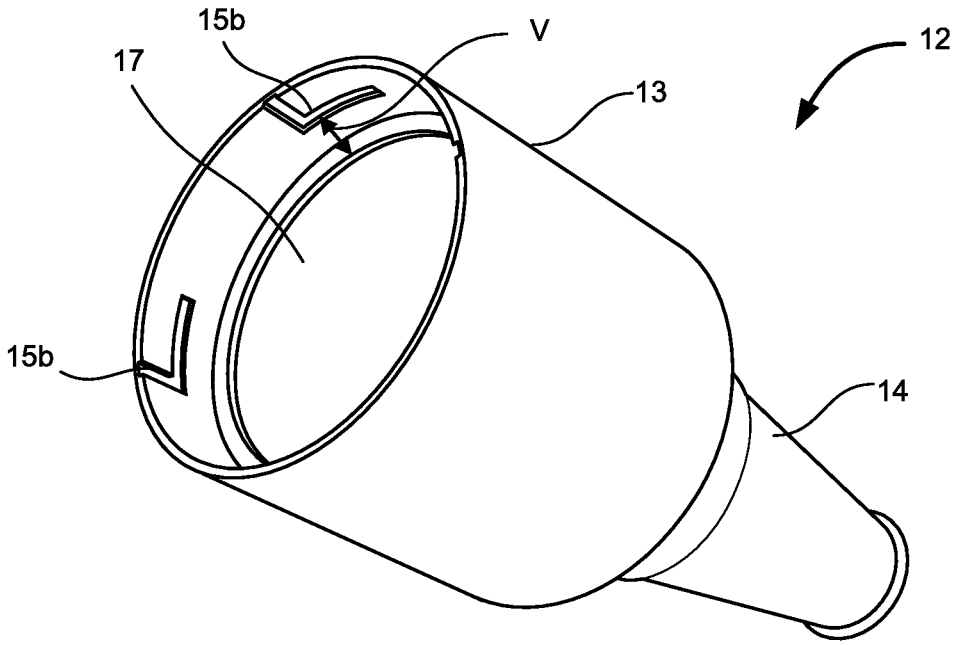
FIG. 3 illustrates a back perspective view of the first portion of the bottle with a drink seal, in accordance with one embodiment of the present disclosure.
Figure 4:
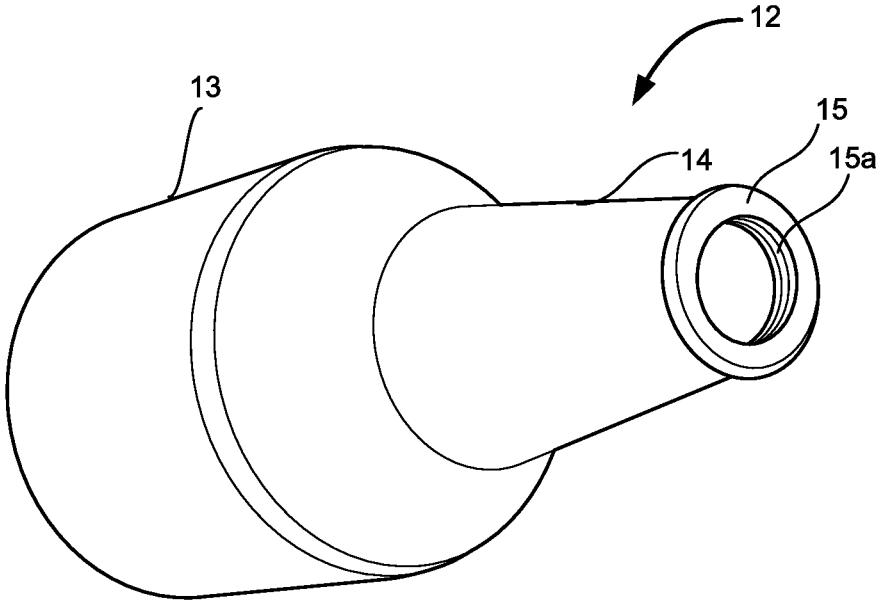
FIG. 4 illustrates a front perspective view of the first portion of the bottle, in accordance with one embodiment of the present disclosure.

Referring to the FIGS. 2-4, the first portion 12 comprises a bowl portion 13 and a neck portion 14. The first portion 12 is preferably hollow inside and is provided in a shape of a regular beverage bottle. The bowl portion 13 may preferably form a cylindrical body like any conventional bottle known in the art. The neck portion 14 extends vertically upward and comprises an end 15. The first portion 12 is used to store beverage such as a wine, juice or water and the like. Preferably, the first portion 12 is used to store a single serve of beverage. The first portion 12 may be made up of but not limited to plastic material, ceramic material, stainless steel or other metallic material, bioresins, wooden material, and glass material. It should be noted the diameter of the bowl portion 13 is preferably made greater than the diameter of the neck portion 14. In one implementation, the neck portion 14 may be tapered at the top end 15, such that the beverage can flow out easily through the end 15.

According to the embodiment, the end 15 is closed end to restrict the flow of the beverage therefrom and the end 15 is threaded 15*a* inside for receiving a threaded portion 19 of a closure member 18 that shall be described in detail in the following description. The first portion 12 further includes one or more grooves 15*b* circumferentially present over inner wall of the bowl portion 13 of the first portion 12.

Further, as seen in the FIG. 3, when the beverage particularly the first serve of the beverage is contained in the first portion 12 of the bottle 10, the beverage is sealed inside using a drink seal or seal 17. The drink seal 17 may include any suitable non-permeable membrane for example made of foil paper or plastic material that can restrict the flow of beverage out of the first portion 12 of the bottle 10 and also doesn't react with the beverage contained inside the first portion 12, when the bottle 10 is in use and the user tries to pull apart the first portion 12 and the second portion 16 in order to consume the first serve of the beverage contained in the first portion 12.

Figure 5:
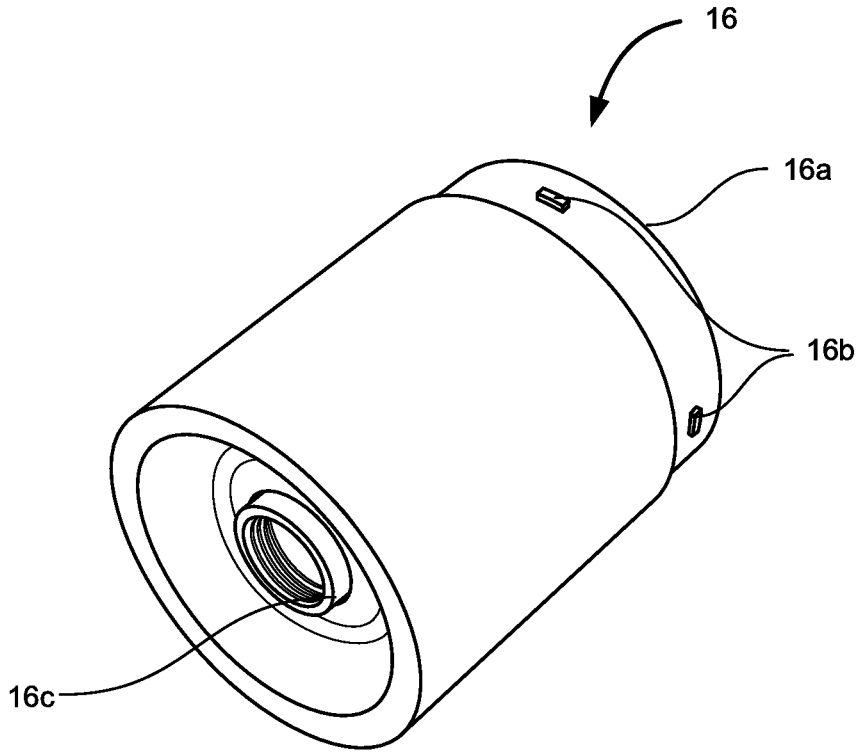
FIG. 5 illustrates a back perspective view of the second portion of the bottle with a receiving end for receiving a closure member, in accordance with one embodiment of the present disclosure.
Figure 6:
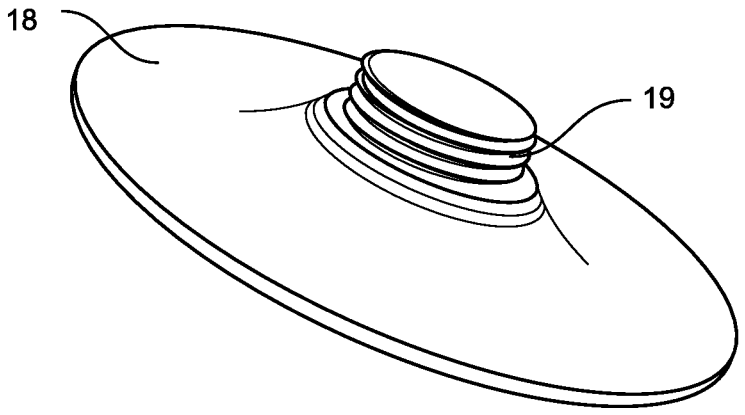
FIG. 6 illustrates the closure member, in accordance with one embodiment of the present disclosure.

Referring to the FIG. 2 and the FIGS. 5-6, the second portion 16 comprises a cylindrical structure or a bowl like structure. In some embodiments, the second portion 16 can appear in the form of standard glass like structure as well. The second portion 16 is used to store beverage such as a wine, juice or water and the like. The second portion 16 may be made using but not limited plastic material, ceramic material, stainless steel or other metallic material, bioresins, wooden material, and glass material. The second portion 16 is provided as a hollow structure to hold second serve of the beverage, according to the preferred embodiment of the present invention. According to the embodiment, apart from holding the second serve of the beverage, the second portion 16 can also act as separate standard glass for drinking the second serve of beverage contained therein. The second portion 16 comprises a receiving end 16*c* which is threaded inside. The second portion 16 further includes an engaging end 16*a*. The second portion 16 comprises one or more notches 16*b* circumferentially distributed over outer surface of the second portion 16 at the engaging end 16*a*. In an implementation, the beverage particularly the second serve of the beverage contained in the second portion 16 of the bottle 10, the beverage is sealed inside using a drink seal or seal (not shown). The drink seal may include any suitable non-permeable membrane for example made of foil paper or plastic material that can restrict the flow of beverage out of the second portion 16 of the bottle 10 and also doesn't react with the beverage contained inside the second portion 16, when the bottle 10 is in use and the user tries to pull apart the first portion 12 and the second portion 16 in order to consume the second serve of the beverage contained in the second portion 16. The drink seal 17 present in the first portion 12 and the drink seal (not shown) present in the second portion 16 may or may not be of like material and serve to seal the beverage content so that the beverage content doesn't spill over or lose the freshness when the first portion 12 and the second portion 16 are pulled apart and kept disassembled for longer time.

As seen in the FIG. 2, the bottle 10 may comprise a first closure member 18 engaged to the second portion 16 of the bottle 10. The first closure member 18 according to one implementation is best shown in FIG. 6. The closure member 18 may be made using one of plastic, ceramic, stainless steel or any other suitable material. According to an implementation, as seen in the FIG. 6, the closure member 18 may comprise the threaded portion 19 at one end. Further, the closure member 18 may have a flat surface at another end. In order to form the engagement with the second portion 16 of the bottle 10, the closure member 18 is rotatably screwed (using its threaded portion 19) onto the receiving end 16*c* (having threaded region that complements to the threaded portion 19) of the second portion 16.

In use, in order to assemble the first portion 12, the second portion 16 and the closure member 18 together to form the bottle 10, the closure member 18 may be placed on a flat surface such as ground or on a table. Subsequently, the second portion 16 may be coupled to the closure member 18 using the threaded portion 19 present in the closure member 18 and the receiving end 16*c* present in the second portion 18 (just by a simple rotational action). Once the second portion 16 is coupled to the closure member 18, the first portion 12 may be placed on top of the second portion 16. The notches 16*b* present on the engaging end 16*a* of the second portion 16 would releasably fit into the grooves 15*b* present on the first portion 12 thereby removably engaging the first portion 12 to the second portion 16. For the purpose of this invention and disclosure, the one or more grooves 15*b* on the first portion 12 and the one or more notches 16*b* on the second portion 16 will be collectively termed as engaging mechanism. Once the first portion 12, second portion 16 and the closure member 18 are assembled together, the underlying shape appear like a bottle of wine that is known in the art and as best shown in the FIG. 1.

Figure 7:
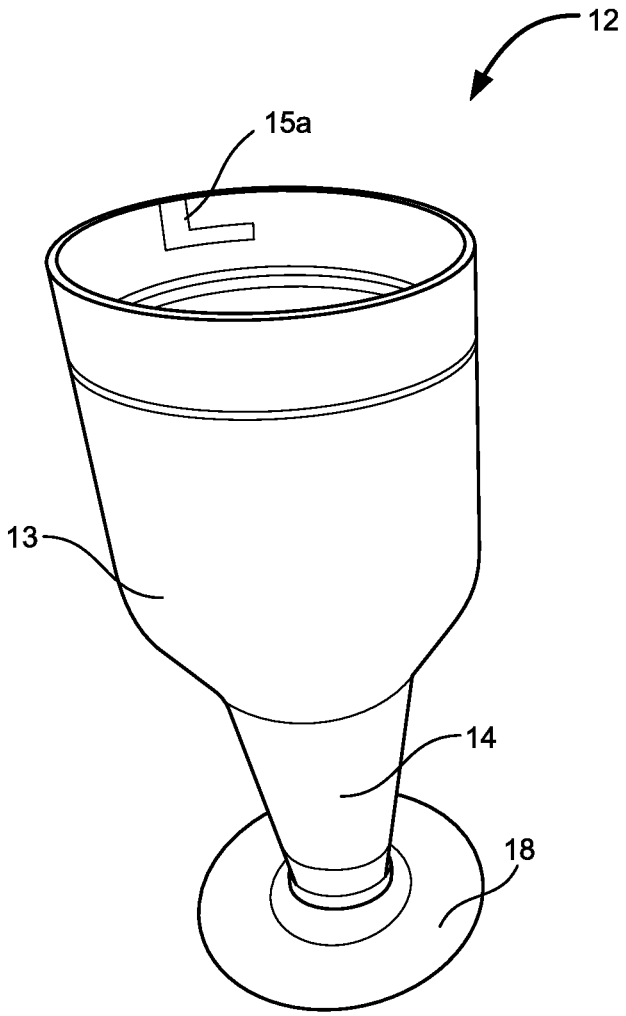
FIG. 7 illustrates the first portion coupled to the closure member with the seal removed, in accordance with one embodiment of the present disclosure.

In use, in order to disassemble the first portion 12, the second portion 16 and the closure member 18 to convert the bottle 10 into the glass, a user can simply pull apart the first portion 12 and the second portion 16. It could be simple pull apart by applying force (to disengage the notches 16*b* from the grooves 15*b*) or it could be that the user may need to rotate the second portion 16 a bit so that the notches 16*b* present in the second portion 16 comes out of the grooves 15*b* present in the first portion 12. Once the first portion 12 and the second portion 16 are pulled apart, the user can unscrew the closure member 18 from the second portion 16. Once the closure member 18 is disengaged then the user can engage the same closure member 18 on the top end 15 of the first portion 12, within the threaded region 15*a* as shown in FIG. 7. Referring to the FIG. 7, the first portion 12 is shown with the closure member 18 engaged on the top end 15 and the setup so formed is placed on the surface upside down. The user can use the same as a glass or drink glass and can consume the first serve of the beverage contained in the first portion 12 after removal of the inner drink seal 17 as shown in the FIG. 3.

Referring to the FIGS. 8-13, another possible embodiment or implementation is shown. A bottle 20 that can be converted or transformed into a glass is shown in the FIG. 8. The bottle 20 comprises a first portion 21, and a second portion 25.

Figure 8:
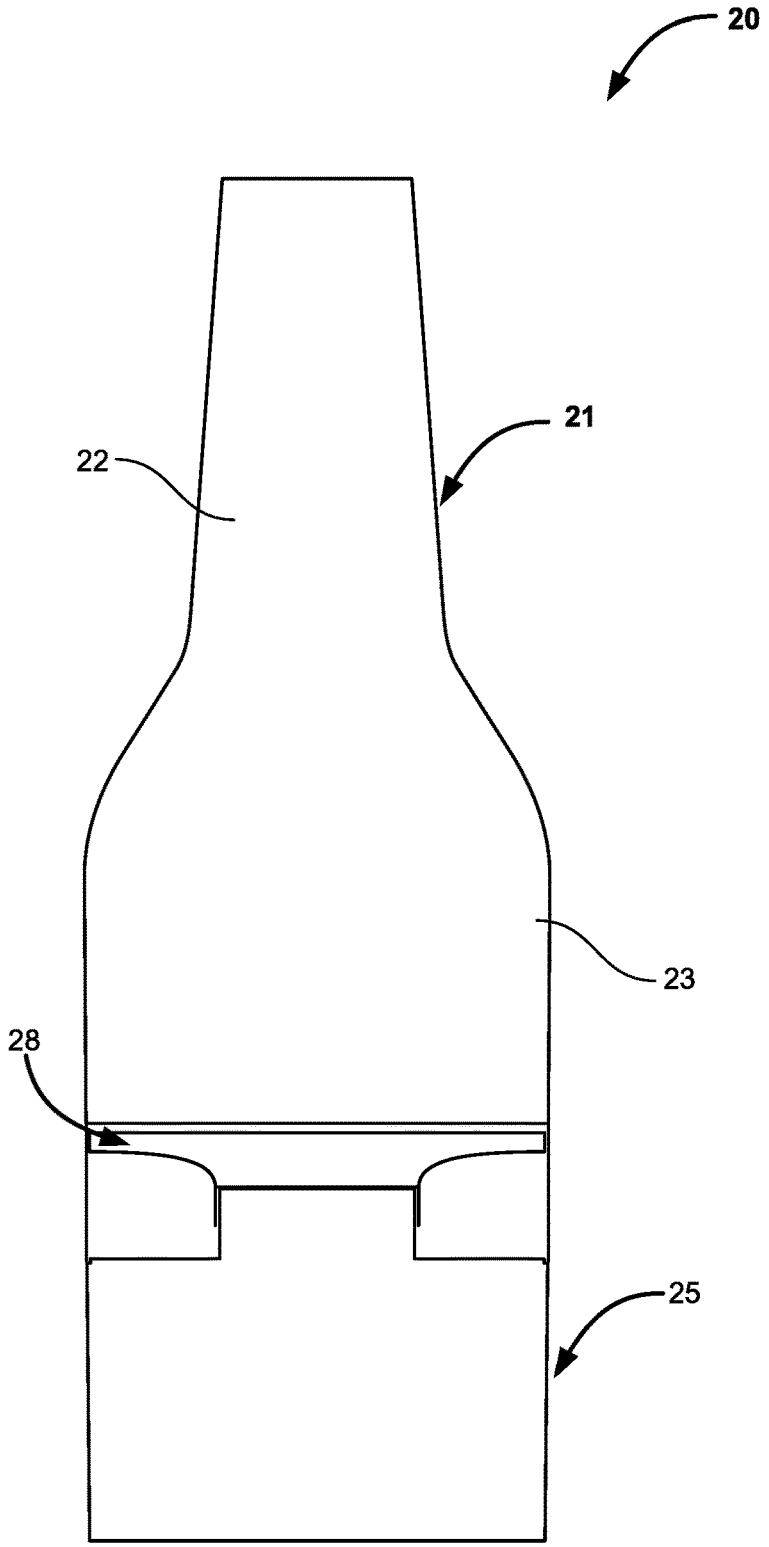
FIG. 8 illustrates a bottle that can be transformed into a glass, in accordance with another embodiment of the present disclosure.
Figure 9:
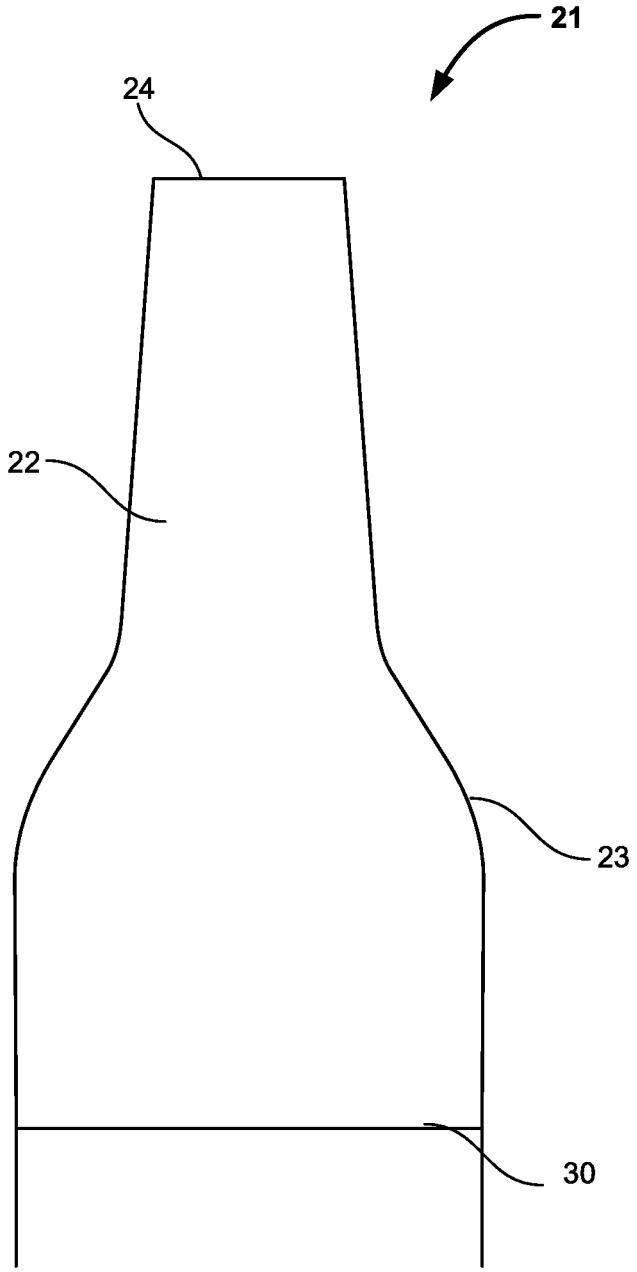
FIG. 9 illustrates a first portion forming a part of the bottle of the FIG. 8.

Referring to the FIG. 8-9, the first portion 21 comprises a bowl portion 23 and a neck portion 22. The first portion 21 is provided in a shape of bottle. The neck portion 22 extends vertically upward and comprises an end 24. The first portion 21 is used to store first serve of the beverage such as a wine, juice or water and the like. The first portion 21 may be made using but not limited to plastic material, ceramic material, stainless steel or other metallic material, bioresins, wooden material, and glass material. It should be noted the diameter of the bowl portion 23 is made greater than the diameter of the neck portion 22. Further, as shown, the beverage content in the first portion 21 may be sealed using a drink seal 30 similar to the seal 17 explained above with respect to the FIG. 3.

Figure 10:
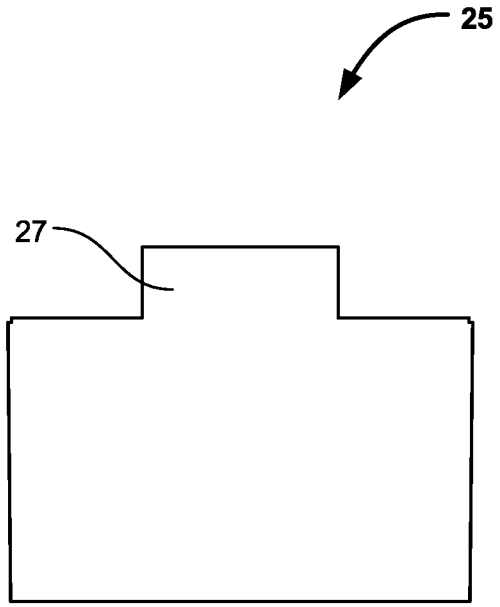
FIG. 10 illustrates a second portion forming a part of the bottle of the FIG. 8.

Referring to the FIG. 10, the second portion 25 comprises a cylindrical structure or a bowl or a standard glass like structure that acts as a reserve for the second serve of the beverage or can serve as a glass for drinking as well, if needed. Further, the second portion 25 comprises a head portion 27 as shown in the FIG. 10. The second portion 25 may be made using but not limited to plastic material, ceramic material, stainless steel or other metallic material, bioresins, wooden material, glass material.

Figure 11:
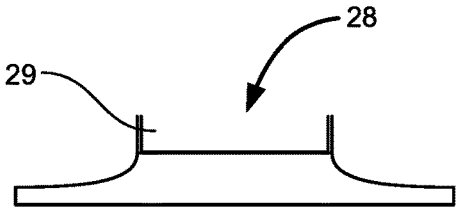
FIG. 11 illustrates a closure member, in accordance with another embodiment of the present disclosure.

Additionally, the bottle 20 may comprise a second closure member 28 as shown in the FIG. 8 and the FIG. 11. The closure member 28 may be made using but not limited to plastic material, ceramic material, stainless steel or other metallic material, bioresins, wooden material, glass material. The closure member 28 may comprise a cut portion 29 at one end as shown in the FIG. 11. Further, the closure member 28 may have a flat surface at another end.

Figure 13:
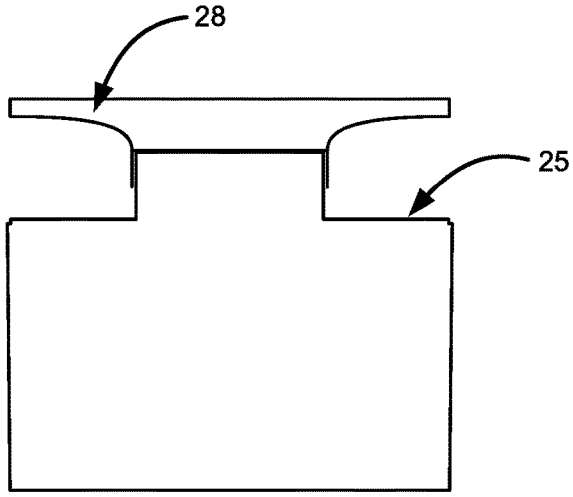
FIGS. 12-13 illustrates the first portion and the second portion of the bottle of the FIG. 8 coupled to the closure member, in accordance with one embodiment of the present disclosure.
Figure 12:
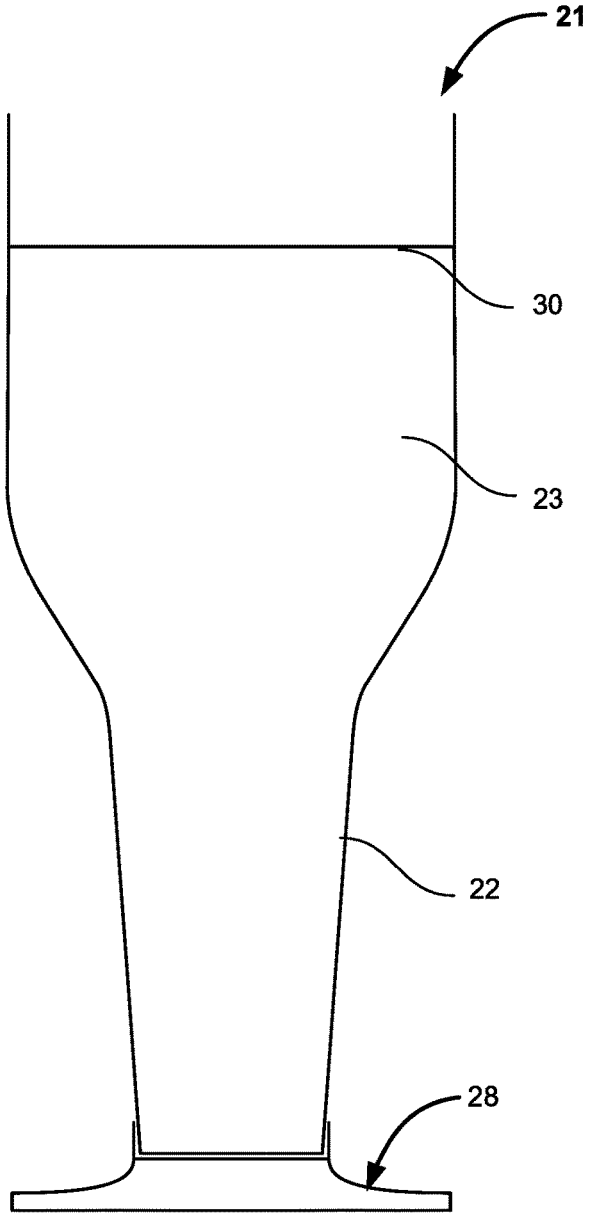

According to the embodiment, the closure member 28 is designed as to snap fit or clip over the top end 24 of the first portion 21 as shown in the FIG. 12 and fit over the head portion 27 of the second portion 25 as shown in the FIG. 13. Further, the first portion 21 and the second portion 25 may include a provision (Eg. clips present internally on the inner wall of the first portion 21 and the clips present on the outer surface of the second portion 25) that would help the first portion 21 to clip fit or snap fit over the second portion 25. For the purpose of this invention the provision that helps the first portion 21 to removably connect onto the second portion 25 is referred as engaging mechanism.

In use, in order to assemble the first portion 21, the second portion 25 and the closure member 28 together to form the bottle 20, the closure member 28 may be placed or fitted over the head portion 27 of the second portion 25. Subsequently, the first portion 21 may be coupled to the second portion 25 using the engaging mechanism. Once the first portion 21 is coupled to the second portion 25, the underlying shape would appear like a bottle of wine that is known in the art and as best shown in the FIG. 8.

In use, in order to disassemble the first portion 21, the second portion 25 and the closure member 28 in order to convert the bottle 20 into the glass, the user can simply unclip or pull apart the first portion 21 and the second portion 25. It could be simple pull apart by applying force (to disengage provision that clips the first portion 21 with the second portion 25). Once the first portion 21 and the second portion 25 are pulled apart, the user can the pull apart or disengage the closure member 28 from the head portion 27 of the second portion 25. Once the closure member 28 is disengaged then the user can engage the same closure member 28 on the top end 24 of the first portion 21 as shown in the FIG. 12. Referring to the FIG. 12, the first portion 21 is shown with the closure member 28 engaged on the top end 24. The user can use the same as a glass or drink glass and can consume the first serve of the beverage contained in the first portion 21 after removal of the inner drink seal 30.

Referring to FIGS. 14A-14B, and FIGS. 15-16, another exemplary embodiment of the bottle convertible to a drink glass is represented. Like the other embodiments described above, the bottle 40 comprises a first portion 41 and a second portion 42.

The first portion 41 comprises a bowl portion 41*b*, and a neck portion 41*a*. The first portion 41 is provided in a shape of bottle. The neck portion 41*a* extends vertically upward and comprises an end 46. The end 46 may or may not be tapered based on the design needs. The first portion 41 is used to store first serve of the beverage such as a wine, juice or water and the like. The first portion 41 may be made using but not limited to plastic material, ceramic material, stainless steel or other metallic material, bioresins, wooden material, and glass material. It should be noted the diameter of the bowl portion 41*b* is made greater than the diameter of the neck portion 41*a*. Further, as shown, the beverage content in the first portion 41 may be sealed using a drink seal 43 similar to the seal 17 explained above with respect to the FIG. 3.

The second portion 42 comprises a cylindrical structure or a bowl like structure or a glass like structure that acts as a reserve for the second serve of the beverage and may be used as a separate standard glass as well for drinking the second serve of beverage contained therein. Further, the second portion 42 comprises two ends 42*a*, and 42*b* as shown in the FIG. 15. The second portion 42 may be made using but not limited to plastic material, ceramic material, stainless steel or other metallic material, bioresins, wooden material, glass material. The second portion 42 may also include a seal (not shown) for sealing the beverage content present in the second portion. The seal may be present at the end 42*a*, or 42*b* or at both ends.

Figure 14A:
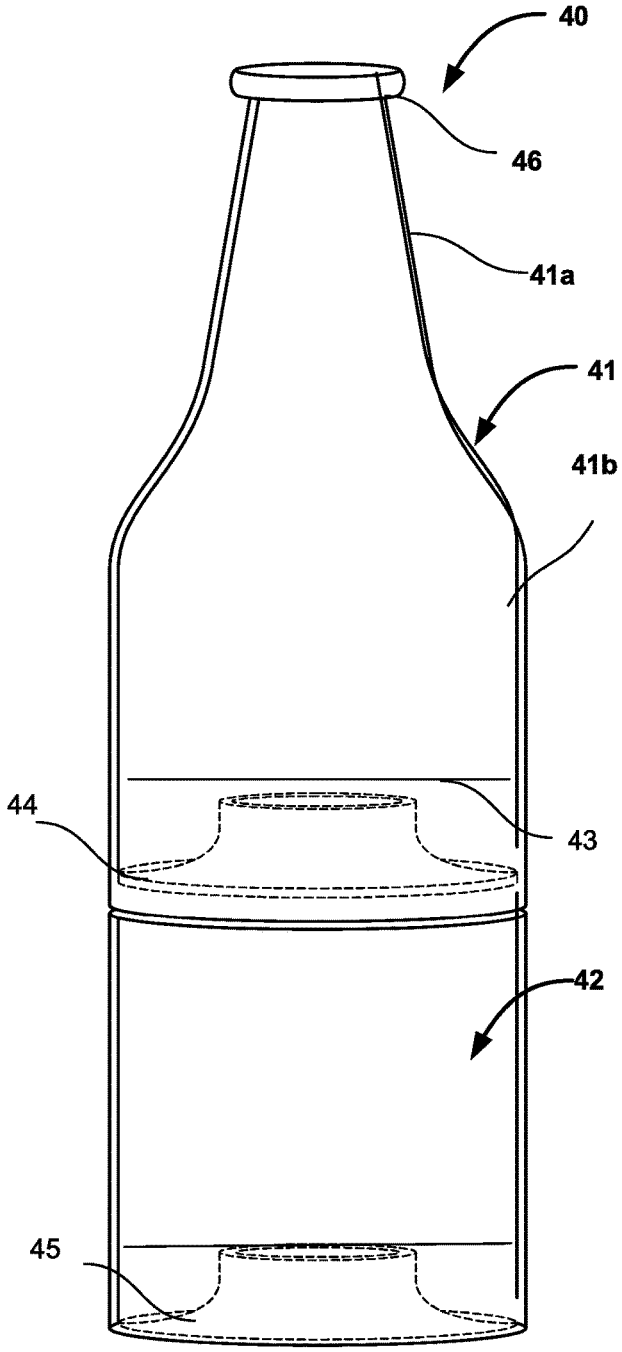
FIGS. 14A-14B illustrates another exemplary alternative embodiment of the present invention.
Figure 14B:
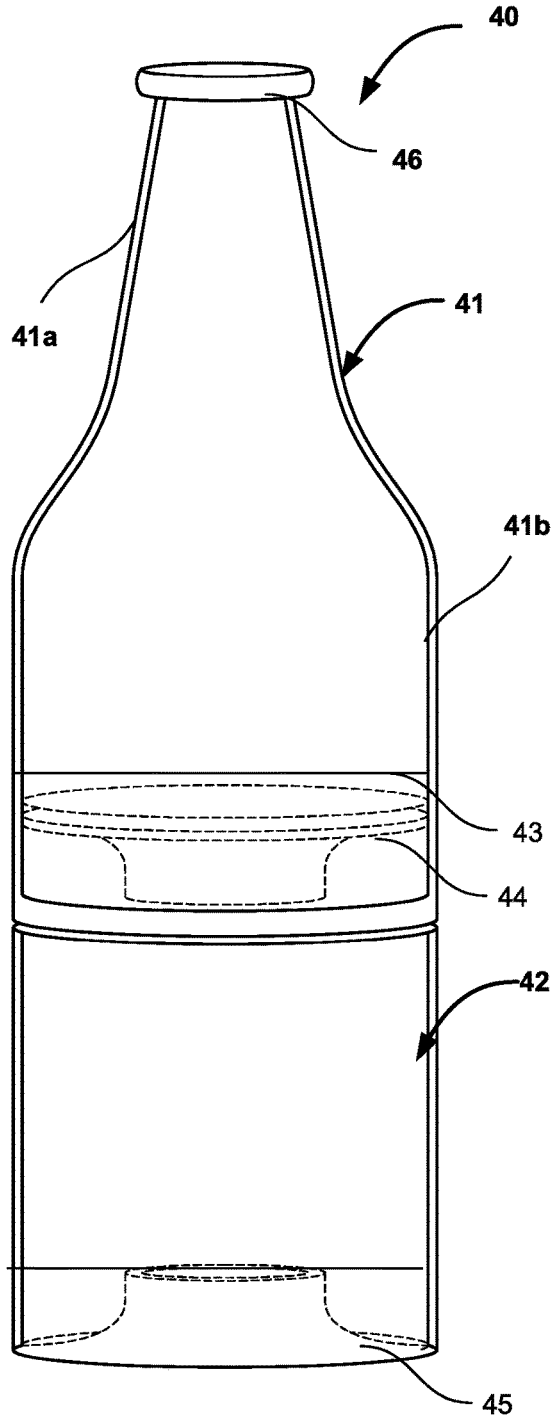
Figure 15:
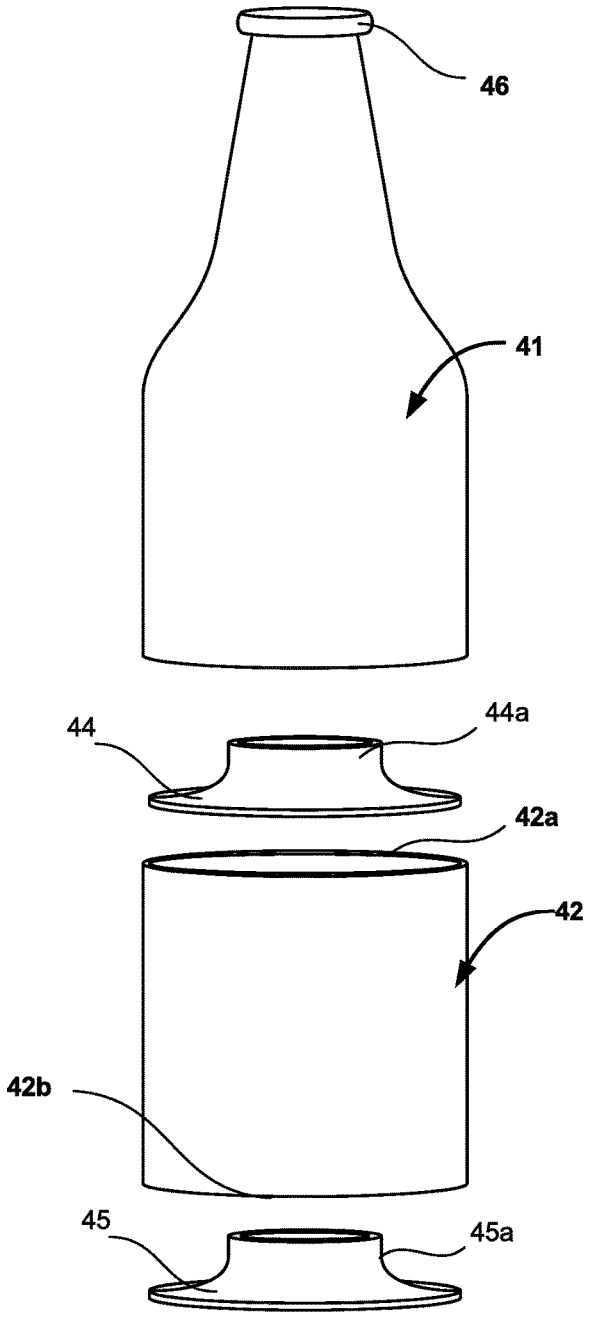
FIG. 15 illustrates an exploded view of the bottle of the FIG. 14A, in accordance with an embodiment.

Additionally, the bottle 40 may comprise closure members 44, 45 as shown in the FIGS. 14A, 14B and the FIG. 15. The closure members 44, 45 may be made using but not limited to plastic material, ceramic material, stainless steel or other metallic material, bioresins, wooden material, glass material. The closure members 44, 45 may comprise an engaging end 44*a*, 45*a* at one end and be flat on the other end as shown in the FIG. 15.

Figure 16:
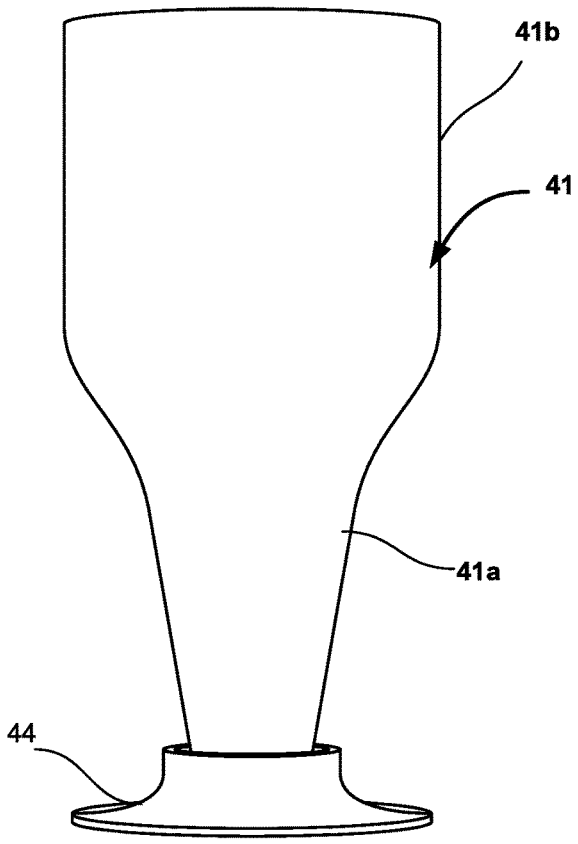
FIG. 16 illustrates a drink glass converted out of the bottle in the FIGS. 14A-14B.

According to the embodiment, the closure members 44, 45 are designed as to snap fit or clip or any other suitable mechanism over the top end 46 of the first portion 41 through their engaging end 44*a*, 45*a* as shown in the FIG. 16 and fit on the ends 42*b* of the second portion 42 as shown in the FIG. 15. Further, the first portion 41 and the second portion 42 may include a provision (Eg. Clips or like provision) that would help the first portion 41 to clip fit or snap fit over the second portion 42. For the purpose of this invention the provision that helps first portion 41 to removably connect onto the second portion 42 is referred as engaging mechanism.

Further, as seen, in the FIGS. 14A-14B, and the FIG. 15 in conjunction to the FIG. 3, the closure member 44 is disposed within a void region (region shown by a double headed arrow and represented by 'V' in the FIG. 3) within the first portion 41 in a way such that when the first portion 41 and second portion 42 are assembled together the closure member 44 securely lies within the void region without disturbing the engagement of the first portion 41 and the second portion 42, and when the user disassembles the bottle 40 to convert the first portion 41 to a drinking glass represented in the FIG. 16, the user can use the closure member 44 housed within the void region "V" to form the base or support for the glass as shown in the FIG. 16. It should also be understood that, the use of the closure member 44 to form the support or base for the glass is optional, if the user wishes, the user can even disengage the closure member 45 and use the same for forming the base or support for the glass. Thus, objective of the embodiment disclosed in the FIGS. 14A-14B, is to provide two way options to the user to transform the bottle 40 into the drink glass.

Figure 17:
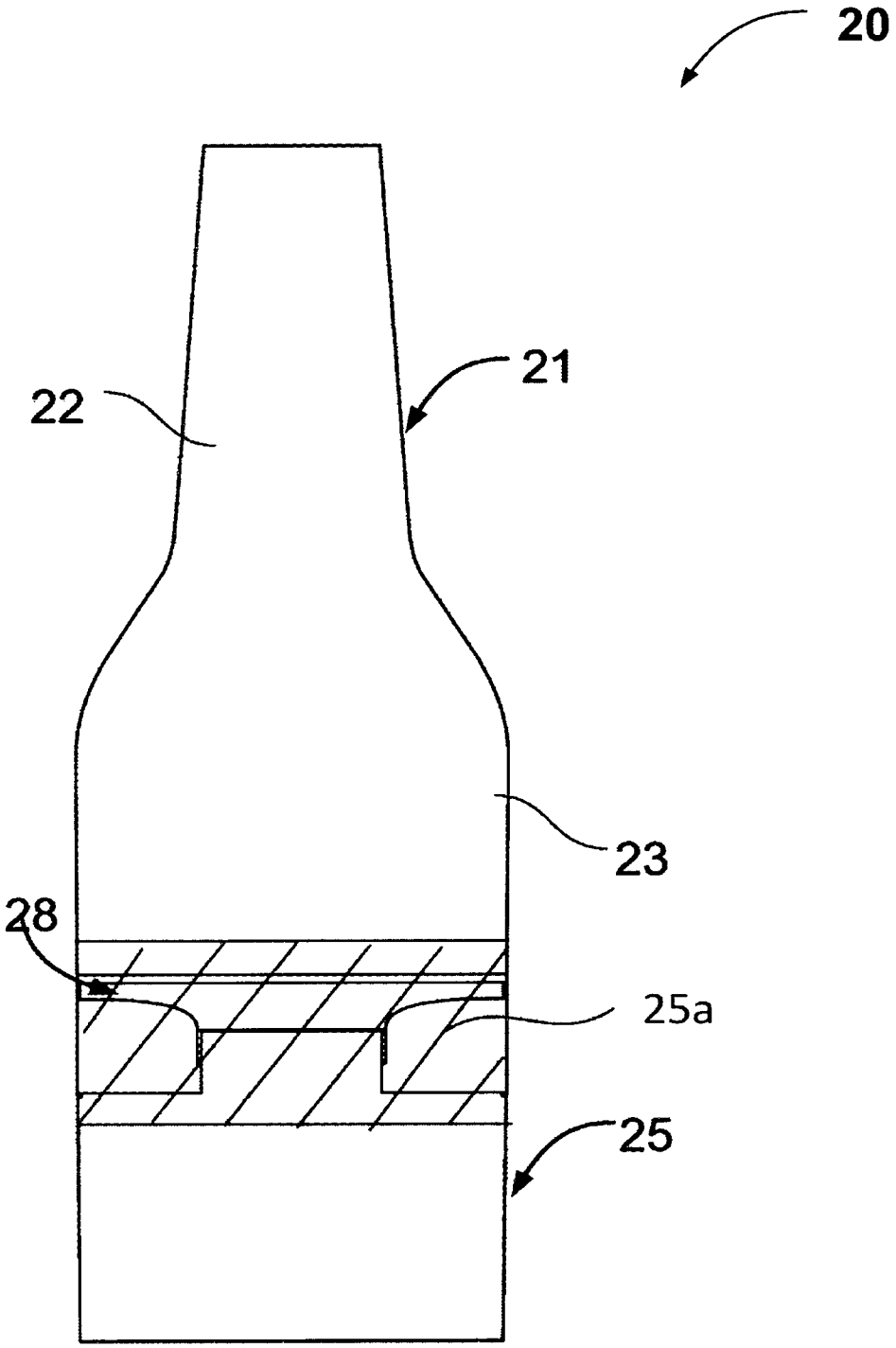
FIG. 17 illustrates the bottle of the FIG. 8 with an external packaging partially covering the bottle over the point where the first portion and second portion engage with each other, in accordance with an exemplary embodiment.

Referring to FIG. 17, a bottle 20 as explained with respect to the FIGS. 8-13 is shown along with a packaging/label 25*a* externally present (partially covering the bottle) all around the outer surface of the bottle 20. The packaging 25*a* covers the bottle 20 externally especially over the region or point where the first portion 21 engages with the second portion 25. The external packaging 25*a* serves to provide additional coupling strength to hold the first portion 21 and the second portion 25 together. In use, this packaging 25*a* needs to be removed first before disengaging the first portion 21 from the second portion 25 unlike the other embodiments explained above. Although the illustration conveys the packaging 25*a* applied over the bottle represented in the FIG. 8, it should be understood that the packaging 25*a* can form the part of other possible bottle designs illustrated in the FIG. 1 and FIG. 14 as well. The packaging 25*a* may preferably be made using commercially available material such as plastic. This packaging or label 25*a* can also include any brand names or logos by which the convertible bottles would be marketed.

The proposed bottle can be easily filled using modern bottling equipment. The proposed convertible bottle increases efficiency with respect to raw materials, production costs, transportation, and storage space by alleviating the need for a separate wine glass.

The design of a bottle may be used as a disposable cup and storage for events. In one example, the bottle may be used for two serves of similar or different nature, for example, one portion of the bottle can hold wine whereas other portion of the bottle can hold fruit juice. Likewise, it is also possible, the two portions forming the bottle may hold wines in both the portions. When the first portion and the second portion are assembled each potion holding one serve of the beverage, the underlying design would form a shape of a bottle. Although the embodiments disclosed herein mention storage of the beverages in the two portions, it should be understood that the two portions can be adapted to hold other food items of similar or different nature.

When in use and after pulled apart and screwed or clipped together the bottle will appear like a wine cup/glass (including one serve) and a reserve serve in a separate container.

The closure members may be used as a base or even they can help in further sealing purpose to retain freshness in the beverage.

The bottle may be made using suitable material and in varied shapes and sizes to hold different quantity of two serves in each of the portions and it should be apparent to a person skilled in the art.

In the preceding specification, the present disclosure is described with reference to the specific embodiments. However, it will be apparent to a person with ordinary skill in the art that various modifications and changes can be made, without departing from the scope of the present disclosure. Accordingly, the specification and figures are to be regarded as illustrative examples of the present disclosure, rather than in restrictive sense. All such possible modifications are intended to be included within the scope of present disclosure.

What is claimed is:

1. A bottle (10) convertible to a glass, the bottle comprising:

a first portion (12) adapted for holding a first serve of a beverage, wherein the first portion (12) comprises a bowl portion (13) and a neck portion (14), wherein the neck portion (14) extends vertically upward and comprises a top end (15), wherein a diameter of the bowl portion (13) is greater than a diameter of the neck portion (14), wherein the neck portion is tapered at the top end (15) such that the beverage can flow out easily through the top end (15), wherein the top end (15) is threaded (15*a*) from inside for receiving a threaded portion (19) of a first closure member (18), and wherein the first portion (12) further comprises a plurality of grooves (15*b*) that are circumferentially present over an inner wall of the bowl portion (13), wherein one groove is located separately from another groove;

a second portion (16) adapted for holding a second serve of the beverage, wherein the second portion (16) comprises a receiving end (16*c*) which is threaded from inside, wherein the second portion (16) further comprises an engaging end (16*a*), wherein the second portion (16) further comprises a plurality of notches (16*b*) that are circumferentially distributed over an outer surface of the second portion (16) at the engaging end (16*a*), wherein one notch is located separately from another notch, wherein the second portion (16) and the first portion (12) are configured to removably engage to each other using an engaging mechanism (15*b*,16*b*); and at least one first closure member (18) that comprises a threaded portion (19) at one end, wherein the first closure member (18) has a flat surface at another end, wherein the first closure member (18) removably engages to the receiving end (16*c*) of the second portion (16), wherein, to form the engagement with the second portion (16), the first closure member (18) is rotatably screwed using its threaded portion (19) onto the receiving end (16*c*) having a threaded region that complements to the threaded portion (19) of the second portion (16), wherein, the bottle (10) when in use, the first closure member (18) is removed from the receiving end (16*c*) of the second portion (16) and connected on top (15) of the neck portion (14) of the first portion (12) to form the glass in order to consume the first serve of the beverage contained therein, and if needed refill the glass with the second serve of the beverage contained in the second portion (16).

2. The bottle (10) of claim 1, further comprising at least one second closure member (44) removably housed within a void region (V) present in the first portion (12).

3. The bottle (10) of claim 2, wherein the bottle (10) when in use, the second closure member (44) is removed and connected on the top end (15) of the neck portion (14) of the first portion (12) to form the glass in order to consume the first serve of the beverage contained therein.

4. The bottle (10) of claim 1, wherein the second portion (16) is cylindrical.

5. The bottle (10) of claim 1, wherein the first serve of the beverage and the second serve of the beverage are at least one of same beverages or different beverages.

6. The bottle (10) of claim 1, wherein the first portion (12), the second portion (16), the at least one first closure member (18), and at least one second closure member (44) are made up of plastic material, ceramic material, stainless steel or other metallic material, bioresins, wooden material, and glass material.

7. The bottle (10) of claim 1, further comprising at least a first drink seal (17) for sealing the first serve of the beverage contained within the first portion (12) and at least a second drink seal for sealing the second serve of the beverage contained within the second portion (16), wherein the first drink seal (17) and the second drink seal are used to prevent spilling of the first serve and the second serve of the beverage when the first portion (12) and the second portion (16) of the bottle (10) are disengaged to form the glass for consuming the first serve of the beverage and the second serve of the beverage.

8. The bottle (10) of claim 7, wherein the first drink seal (17) and the second drink seal includes a non-permeable membrane that is made of a foil paper or plastic material, wherein the first drink seal (17) restricts the flow of the beverage out of the first portion (12) of the bottle (10) and also doesn't react with the beverage contained inside the first portion (12), when the bottle (10) is in use and a user tries to pull apart the first portion (12) and the second portion (16) in order to consume the first serve of the beverage contained in the first portion (12), and wherein the second drink seal restricts the flow of the beverage out of the second portion (16) of the bottle (10) and also doesn't react with the beverage contained inside the second portion (16), when the bottle (10) is in use and the user tries to pull apart the first portion (12) and the second portion (16) in order to consume the second serve of the beverage contained in the second portion (16).

9. The bottle (10) of claim 8, wherein the first drink seal (17) present in the first portion (12) and the second drink seal present in the second portion (16) serve to seal the beverage content so that the beverage content doesn't spill over and lose freshness when the first portion (12) and the second portion (16) are pulled apart and kept disassembled for longer time.

* * * * *